US009083133B2

(12) United States Patent
Hutchfield et al.

(10) Patent No.: US 9,083,133 B2
(45) Date of Patent: Jul. 14, 2015

(54) HAND OPERATED CRIMPING TOOL

(75) Inventors: John Hutchfield, Sudbury (GB); Lars Olov Persson, Alvdalen (SE); Niklas Jonasson, Mora (SE)

(73) Assignee: Pressmaster AB, Alvdalen (SE)

( * ) Notice: Subject to any disclaimer, the term of this patent is extended or adjusted under 35 U.S.C. 154(b) by 428 days.

(21) Appl. No.: 13/446,085

(22) Filed: Apr. 13, 2012

(65) Prior Publication Data

US 2012/0260714 A1 Oct. 18, 2012

(30) Foreign Application Priority Data

Apr. 15, 2011 (SE) ..... 1100284-7

(51) Int. Cl.
*H01R 43/042* (2006.01)
*B25B 27/14* (2006.01)

(52) U.S. Cl.
CPC ..... *H01R 43/042* (2013.01); *B25B 27/146* (2013.01)

(58) Field of Classification Search
CPC ..... B21D 7/063; B21D 39/04; B21D 39/048; B25B 7/12; B25B 27/146; H01R 43/042; H01R 43/0425; H01R 43/0428
USPC ..... 72/409.01, 409.06, 412, 414, 416, 479, 72/409.12; 81/342, 345
See application file for complete search history.

(56) References Cited

U.S. PATENT DOCUMENTS

| | | | | |
|---|---|---|---|---|
| 2,722,859 | A | | 11/1955 | Stoltz |
| 2,765,019 | A | | 10/1956 | Evans |
| 2,772,715 | A | | 12/1956 | Neijstrom et al. |
| 3,029,670 | A | * | 4/1962 | Over et al. ..... 72/451 |
| 3,534,583 | A | * | 10/1970 | Demler, Sr. ..... 72/409.08 |
| 3,840,987 | A | | 10/1974 | Netta |
| RE30,848 | E | | 1/1982 | Bauerkemper |
| 4,571,764 | A | | 2/1986 | Chen et al. |
| 5,152,051 | A | | 10/1992 | Folk et al. |
| 6,026,671 | A | * | 2/2000 | Battenfeld ..... 72/409.12 |
| 6,085,422 | A | | 7/2000 | Hirabayashi |
| 6,324,884 | B1 | | 12/2001 | Barjesteh et al. |
| 2011/0197648 | A1 | | 8/2011 | Houser et al. |

FOREIGN PATENT DOCUMENTS

| | | |
|---|---|---|
| DE | 29 03 252 A1 | 9/1980 |
| DE | 298 03 336 U1 | 7/1998 |
| EP | 0 058 375 A1 | 8/1982 |
| EP | 2 362 501 A1 | 8/2011 |
| GB | 585 313 A | 2/1947 |
| GB | 2 185 706 A | 7/1987 |

* cited by examiner

*Primary Examiner* — Debra Sullivan
(74) *Attorney, Agent, or Firm* — Dickstein Shapiro LLP

(57) ABSTRACT

A hand operated crimping tool comprising a body arranged between a distal end and a proximal end of the crimping tool, a tool head arranged distally on the crimping tool, and handles arranged proximally on the crimping tool, where at least one handle is arranged pivotally to the body, and where the tool head is arranged axially slidable along the body. A distal crimping die is arranged at the tool head and a proximal crimping die is arranged at the body between which crimping dies a workpiece is to be crimped. The movement of the handles is connected to the movement of the tool head by a mechanism, whereby the tool head is movable between a distal non-crimping position and a proximal crimping position depending on the relative position of the tool handles.

20 Claims, 9 Drawing Sheets

HAND OPERATED CRIMPING TOOL

FIELD OF THE INVENTION

The present invention relates to a hand operated crimping tool.

BACKGROUND OF THE INVENTION AND RELATED ART

When crimping, a connector i.e. a terminal, splice, contact or a similar device is mechanically secured to at least one cable—e.g to a conductor such as a wire—by deformation so that a solid joint having reliable mechanical and electrical connection is formed. The crimping operation resulting in a crimped joint is performed using crimping dies. Crimping tools may e.g. be hand operated.

In hand operated hand held crimping tools, the crimping tool is usually arranged with two proximally on the crimping tool arranged handles which are movable in relation to each other, where when the user brings the handles towards each other using hand force, usually using one hand only which when placed around both of the handles is squeezed together, the usually distally on the crimping tool arranged crimping dies are brought together in order to crimp at least one workpiece between them.

DE 298 03 336 U 1 shows hand crimping tools with an open head, a closed head, and a head which head may be opened when crimping is not in progress in order to be able to move a workpiece sideways into the head and in order to facilitate the exchange of crimping dies and which head is kept closed during crimping. The crimping tools have a body to which the head is fixed which head is arranged with a fixed crimping die, and in which body a movable crimping die is arranged.

SUMMARY OF THE INVENTION

The primary object of the present invention is to provide an improved hand operated crimping tool.

The above mentioned object is achieved for a hand operated crimping tool having a tool head arranged axially slidable along a tool body, and having the movement of at least one tool handle arranged connected to the movement of the tool head by a mechanism.

According to one embodiment, the mechanism arranged to connect the movement of the handles to the movement of the tool head is a toggle mechanism.

According to one embodiment, the mechanism arranged to connect the movement of the handles to the movement of the tool head is a cam mechanism.

According to another embodiment, the tool head is arranged slidably attached to the body using at least one pin arranged to slide in at least one slot extending axially along the tool.

According to a further embodiment, the body comprises two body parts between which the tool head is arranged to slide.

According to further embodiments, the tool head is open, closed or comprises a pivotable head part.

These and other advantageous features will be apparent from the detailed description below.

The invention will now be described in more detail below with reference to the appended drawings which illustrate preferred embodiments of the device according to the invention.

DESCRIPTION OF PREFERRED EMBODIMENTS

Figure 1:
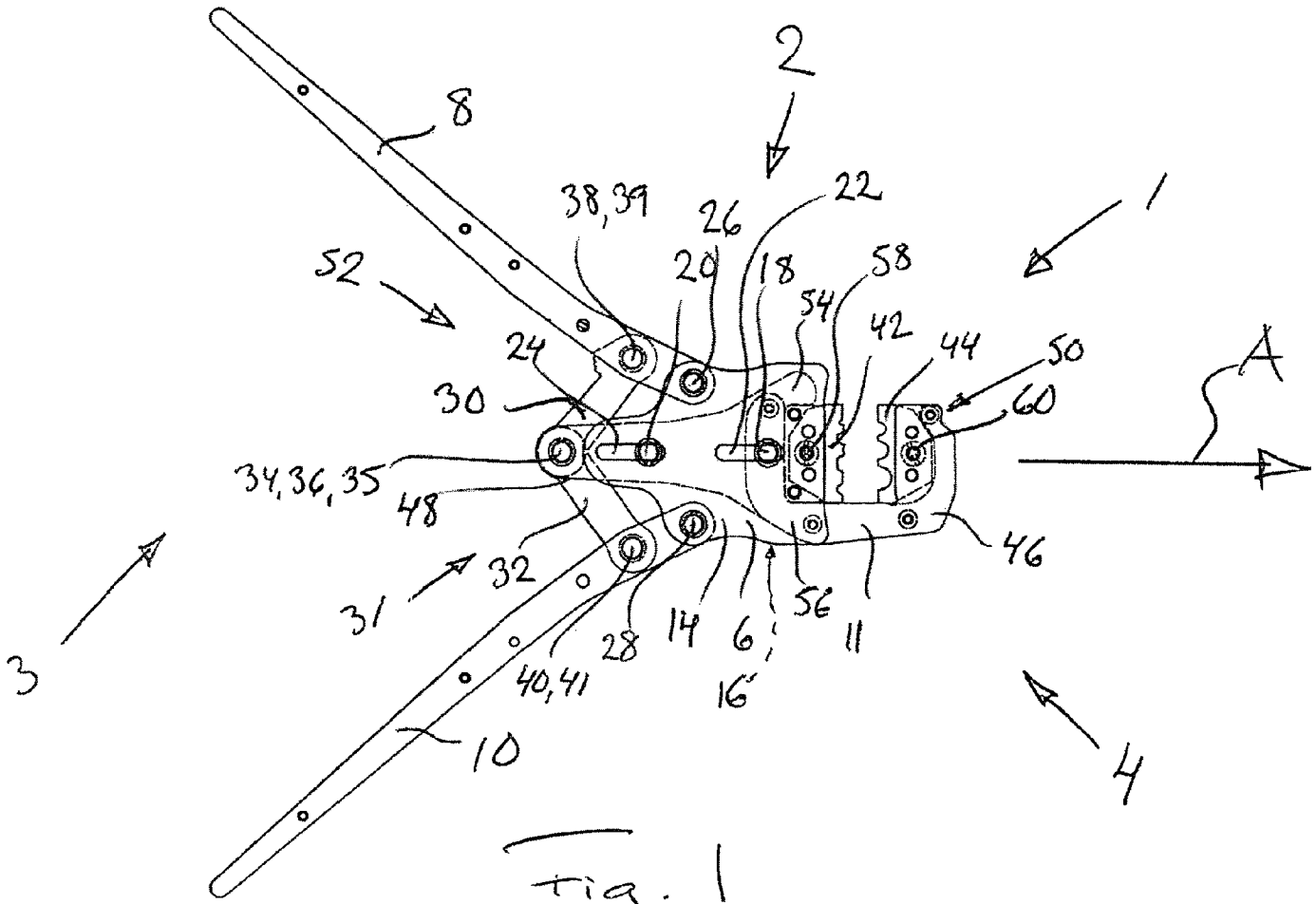
FIG. 1 shows schematically a side view of a hand operated crimping tool having an open tool head according to a first embodiment of the invention, shown in a non-crimping position.

The same reference numerals are being used for similar features in the different drawings.

FIG. 1 shows schematically a side view of a hand operated crimping tool 2 having an open tool head 4 according to a first embodiment of the invention, shown in a non-crimping position. The crimping tool 2 also comprises a body 6 and two handles 8, 10. The body 6 is arranged between the distal end 1 and the proximal end 3 of the crimping tool 2. The tool head 4 is arranged distally 1 on the crimping tool 2, and the two handles 8, 10 are arranged proximally 3 on the crimping tool 2. The tool head 4 comprises a main head part 11 arranged to extend along the body 6. The body 6 preferably comprises two body parts 14, 16 between which the main head part 11 is arranged to slide. For clarity, the parts of the main head part 11 which are obscured by the body part 14 are shown with dashed lines in the figure. The main head part is slidably attached to the body 6 using pins 18, 20 arranged to slide in respective slots 22, 24 extending axially A along the tool 2, where preferably at least two pins 18, 20 are used in order to control the movement of the main head part 11 relative to the body 6. The slots 22, 24 may be arranged in the body 6 or in the main head part 11, and the pins may be arranged in the main head part 11 or in the body 6, respectively. The handles 8, 10 are pivotably attached to the body 6 at pivot points 26, 28. The handles 8, 10 are further connected to the main head part 11 by respective toggles 30, 32 which toggles 30, 32 are pivotably attached to the main head part 11 and a respective handle 8, 10 at pivot points 34, 36; 38, 40, preferably by using pins 35; 39, 41. The movement of the pivotally to the body 6 arranged handles 8, 10 is thus arranged connected to the movement of the main head part 11 by a mechanism 31, here a toggle mechanism, whereby the tool head 4 is arranged movable between a distal non-crimping position and a proximal crimping position depending on the relative position of the tool handles 8, 10. The main head part 11 is arranged axially A slidable along the body 6. Crimping dies 42, 44 are further, preferably removably, arranged at the body 6 and the tool head 4, in this embodiment at the main head part 11, respectively, where a distal crimping die 44 is arranged at the tool head 4 and a proximal crimping die 42 is arranged at the body 6, between which crimping dies 42, 44 at least one workpiece (not shown in this figure) is arranged to be crimped when the crimping dies 42, 44 are moved towards each other. For better understanding of the invention, the parts of the crimping dies 42, 44 which are obscured e.g. by one body part 14 or the main head part 11 are shown with dashed lines in the figure.

The main head part 11 may comprise more than one part, e.g. at least one distal part 46 and at least one proximal part 48. The crimping die 44 may be arranged at the distal end 50 of the distal part 46 and the toggles 30, 32 may be pivotably attached to the proximal end 52 of the proximal part 48. The distal end 54 of the proximal part 48 may be attached to the proximal end 56 of the distal part 46. The distal part 46 may be essentially U-shaped and the proximal part 48 may be essentially Y-shaped.

Said exchangeable crimping dies 42, 44 may further preferably be removably fastened at the body 6 and the main head part 11, respectively, by respective fastening elements 58, 60 such as screws.

Figure 2:
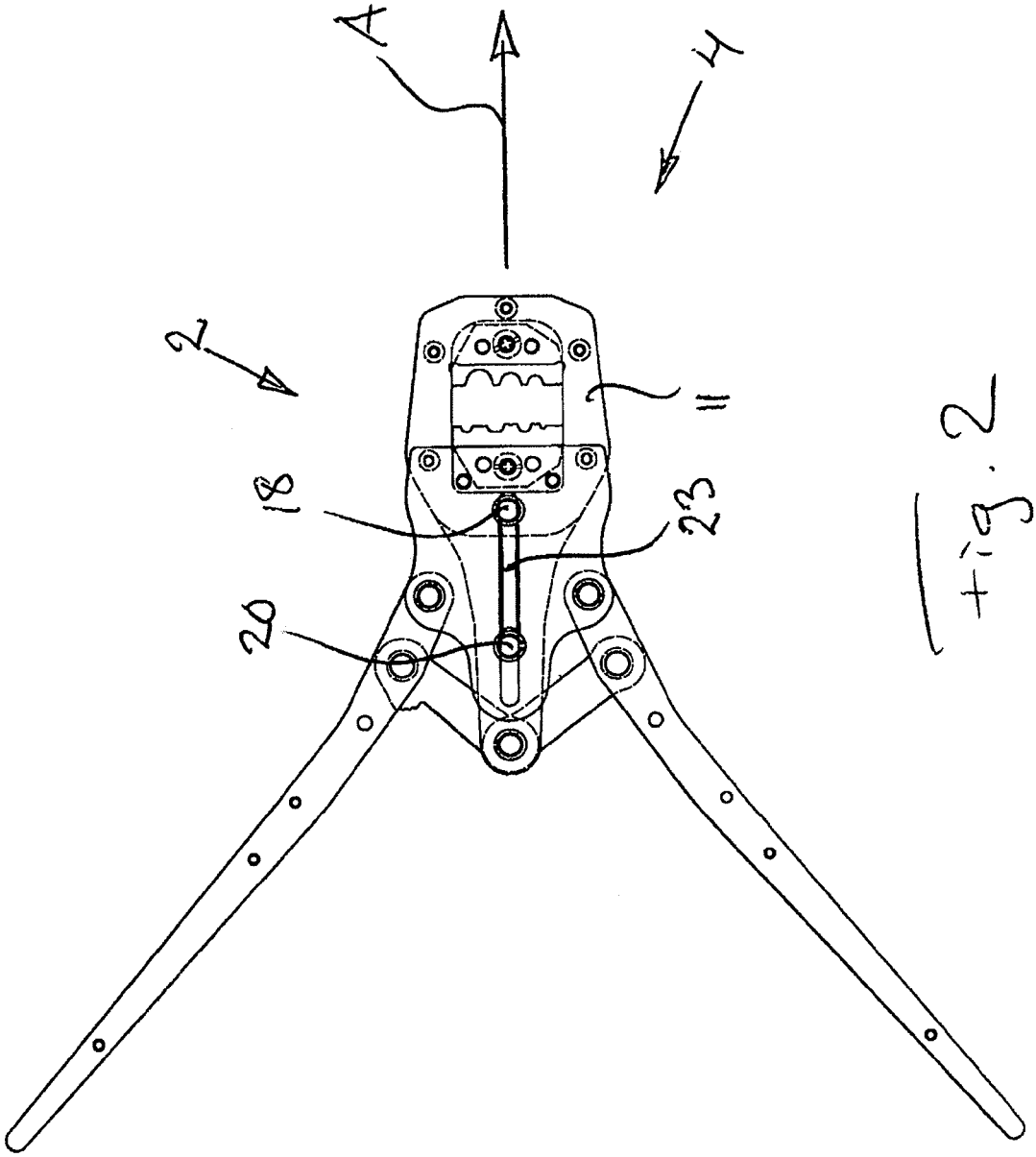
FIG. 2 shows schematically a side view of a hand operated crimping tool having a closed tool head according to a second embodiment of the invention, shown in a non-crimping position.

FIG. 2 shows schematically a side view of a hand operated crimping tool 2 having a closed tool head 4 according to a second embodiment of the invention, shown in a non-crimping position.

The embodiment shown in FIG. 2 differs from the embodiment shown in FIG. 1 in that the tool head 4 is closed and in that the main head part 11 is slidably attached to the body 6 using pins 18, 20 arranged to slide in one slot 23 extending axially A along the tool 2. The slot 23 may be arranged in the body 6 or in the main head part 11, and the pins may be arranged in the main head part 11 or in the body 6, respectively.

Figure 3:
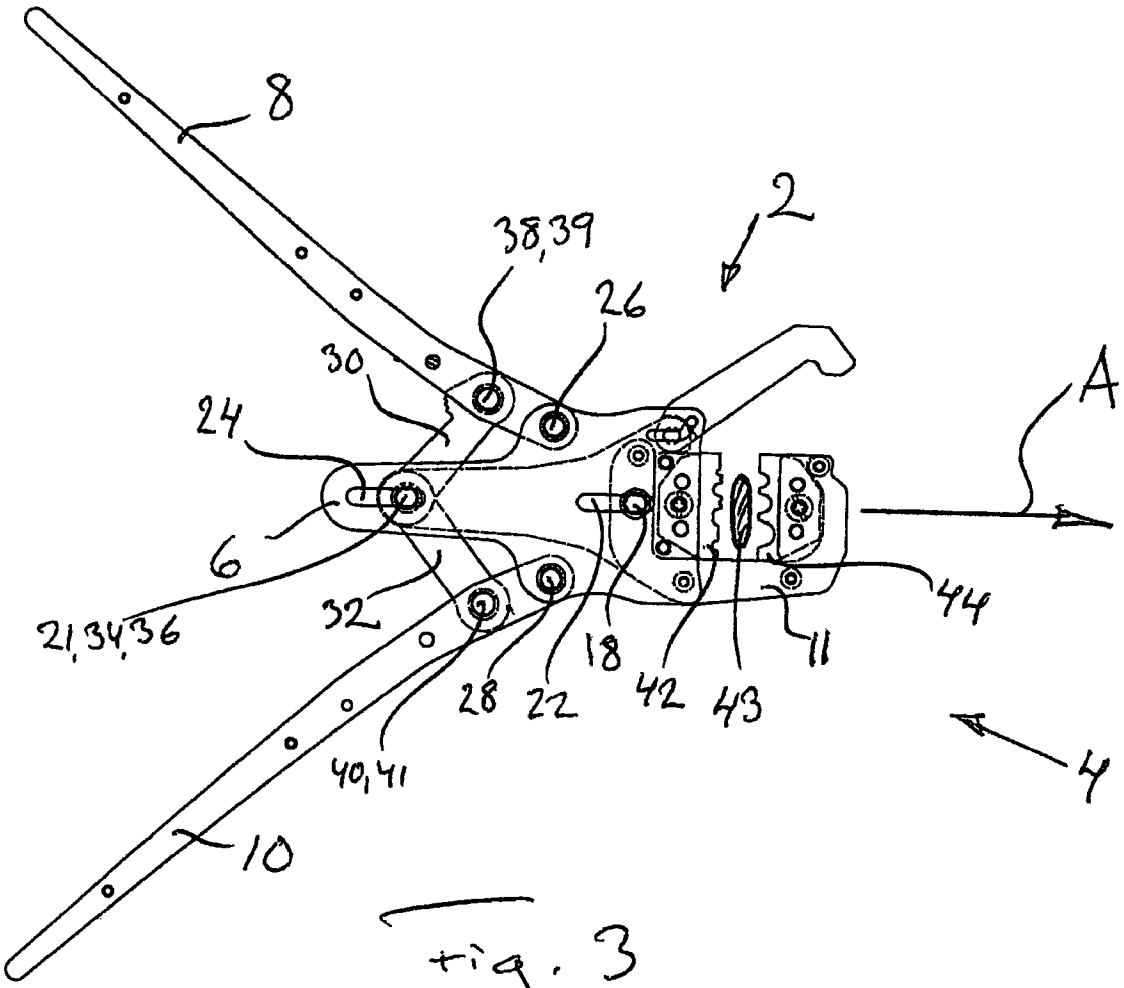
FIG. 3 shows schematically a side view of a hand operated crimping tool having a tool head comprising a pivotable head part according to a third embodiment of the invention, shown in a non-crimping position.

FIG. 3 shows schematically a side view of a hand operated crimping tool 2 having a tool head comprising a pivotable head part 15 according to a third embodiment of the invention, shown in a non-crimping position.

The embodiment shown in FIG. 3 differs from the embodiment shown in FIG. 1 in that the tool head 4 comprises a pivotable head part (as will be discussed in more detail below) and in that the proximal pin 20 shown in FIG. 1 and the pin 35 arranged at the proximal end of the main head part 11 shown in FIG. 1 are substituted by one pin 21 only in the FIG. 4 embodiment, and in that the body 6 and the proximal slot 24 extending axially A along the tool 2 in the FIG. 3 embodiment are arranged to extend correspondingly longer as is shown in FIG. 3.

Thus, according to the embodiment shown in FIG. 3, the main head part 11 is arranged to extend along the body 6 and is slidably attached to the body 6 using pins 18, 21 arranged to slide in respective slots 22, 24 extending axially A along the tool 2, where preferably at least two pins 18, 21 are used in order to control the movement of the main head part 11 relative to the body. The slots 22, 24 may be arranged in the body 6 or in the main head part 11, and the pins may be arranged in the main head part 11 or in the body 6, respectively. The handles 8, 10 are pivotably attached to the body 6 at pivot points 26, 28. The handles 8, 10 are further connected to the main head part 11 by respective toggles 30, 32 which toggles 30, 32 are pivotably attached to the main head part 11 and a respective handle 8, 10 at pivot points 34, 36; 38, 40, preferably by using pins 21; 39, 41. Crimping dies 42, 44 are further, preferably removably, arranged at the body 6 and the tool head 4, in this embodiment at the main head part 11, respectively, where distal crimping die 44 is arranged at the tool head 4 and a proximal crimping die 42 is arranged at the body 6, between which crimping dies 42, 44 at least one workpiece 43 is arranged to be crimped when the crimping dies 42, 44 are moved towards each other.

Figure 4:
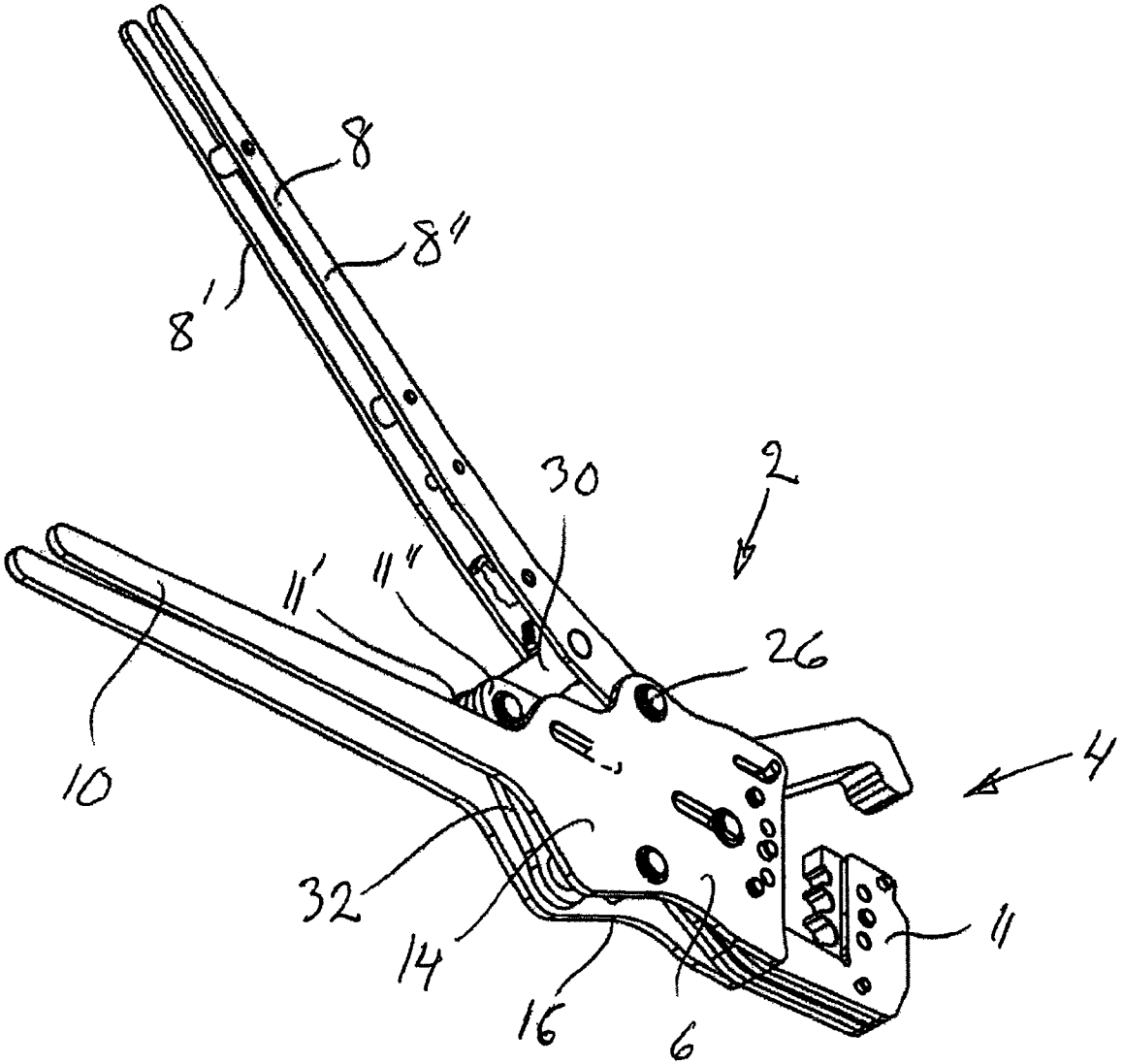
FIG. 4 shows schematically a view of a hand operated crimping tool having a tool head comprising a pivotable head part according to a fourth embodiment of the invention, shown in a non-crimping position.

FIG. 4 shows schematically a view of a hand operated crimping tool 2 having a tool head comprising a pivotable head part 15 according to a fourth embodiment of the invention, shown in a non-crimping position.

The embodiment shown in FIG. 4 differs from the embodiment shown in FIG. 1 in that the tool head 4 comprises a pivotable head part 15 (as will be discussed in more detail below) and in that only one handle 8 is pivotably attached to the body 6 at a pivot point 26 whereas the other handle 10 is fixed to the body 6. As is shown in the figure, the body 6 preferably comprises two body parts 14, 16 between which the main head part 11 is arranged to slide.

As can be seen in FIG. 4 (and which also applies to all the other embodiments described herein), e.g. the handles 8, 10, the main head part 11, or the pivotable head part 15 may comprise a number of preferably plate-like sub-parts. E.g., a handle 8 may comprise two sub-parts 8', 8", and the proximal part of the main head part 11 may comprise at least two sub-parts 11', 11" between which at least one toggle 30, 32 may be arranged.

Figure 5:
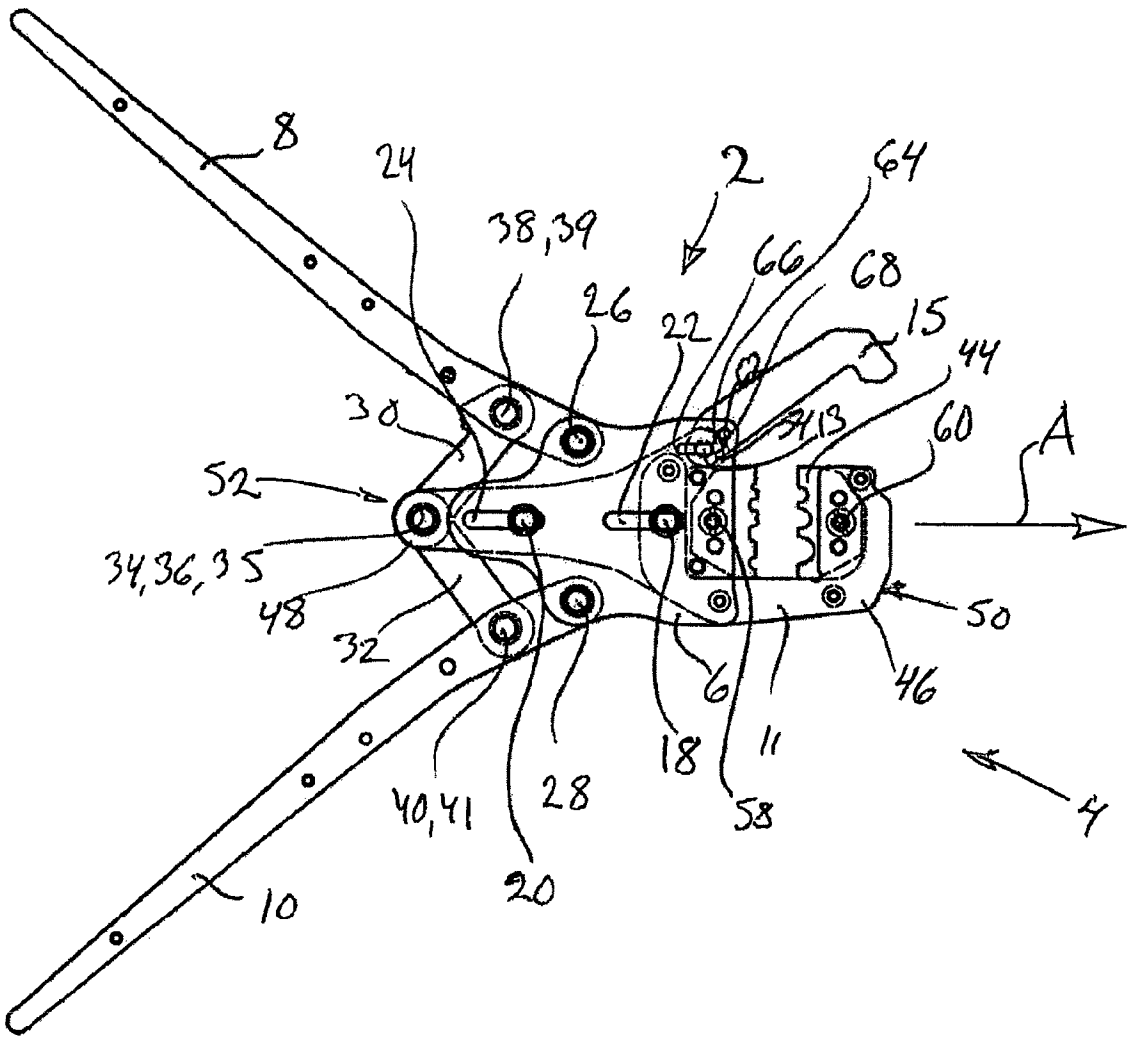
FIG. 5 shows schematically a view of a hand operated crimping tool having a tool head comprising a pivotable head part according to a fifth embodiment of the invention, shown in a non-crimping position.

FIG. 5 shows schematically a view of a hand operated crimping tool 2 having a tool head comprising a pivotable head part 15 according to a fifth embodiment of the invention, shown in a non-crimping position.

The embodiment shown in FIG. 5 differs from the embodiment shown in FIG. 1 in that the tool head 4 comprises a pivotable head part 15 (as will be discussed in more detail below).

The tool head 4 according to this embodiment comprises a main head part 11 and a pivotably thereto at a pivot point 13 attached pivotable latch-like head part 15, where the main head part 11 is arranged to extend along the body 6 and is slidably attached to the body 6 using pins 18, 20 arranged to slide in respective slots 22, 24 extending axially A along the tool 2, where preferably at least two pins 18, 20 are used in order to control the movement of the main head part 11 relative to the body. The slots 22, 24 may be arranged in the body 6 or in the main head part 11, and the pins may be arranged in the main head part 11 or in the body 6, respectively. The handles 8, 10 are pivotably attached to the body 6 at pivot points 26, 28. The handles 8, 10 are further connected to the main head part 11 by respective toggles 30, 32 which toggles 30, 32 are pivotably attached to the main head part 11 and a respective handle 8, 10 at pivot points 34, 36; 38, 40, preferably by using pins 35; 39, 41. Crimping dies 42, 44 are further preferably removably arranged at the body 6 and the tool head 4, in this embodiment at the main head part 11, respectively, where a distal crimping die 44 is arranged at the tool head 4 and a proximal crimping die 42 is arranged at the body 6, between which crimping dies 42, 44 at least one workpiece (not shown in this figure) is arranged to be crimped when the crimping dies 42, 44 are moved towards each other.

The main head part 11 may comprise more than one part, e.g. at least one distal part 46 and at least one proximal part 48. The crimping die 44 may be arranged at the distal end 50 of the distal part 46 and the toggles 30, 32 may be pivotably attached to the proximal end 52 of the proximal part 48. The distal end 54 of the proximal part 48 may be attached to the proximal end 56 of the distal part 46. The pivotable head part 15 may further be pivotably attached at a pivot point 13 to the distal end 54 of the proximal part 48. The distal part 46 may be essentially U-shaped and the proximal part 48 may be essentially Y-shaped.

Said exchangeable crimping dies 42, 44 may further preferably be removably fastened at the body 6 and the main head part 11, respectively, by respective fastening elements 58, 60 such as screws.

In order to achieve that the pivotable head part 15 of the tool head 4 is automatically moved between an open head position and a closed head position depending on the relative position of the tool handles 8, 10 as will be discussed in more detail below, the pivotable head part 15 is further arranged to be slidably guided along a curved path along the body 6 by using at least one pin 62 arranged to slide in a curved slot 64, the curved slot 64 defining the curved path. The curved slot 64 may be arranged in the body 6 or in the pivotable head part 15, and at least one pin 62 may be arranged in the pivotable head part 15 or in the body 6, respectively.

According to this embodiment, the curved slot 64 is arranged in the body 6 and the at least one pin 62 is arranged in the pivotable head part 15, where further the curved slot 64 is arranged at its proximal end 66 to extend in parallel with the above mentioned slots 22, 24 extending axially A along the tool 2, whereas the curved slot 64 is arranged towards its distal end 68 to extend at an angle to and away from the above mentioned slots 22, 24. Thus, when the pin 62 arranged in the pivotable head part 15 moves along the curved slot 64 in parallel to the above mentioned slots 22, 24, the pivotable head part 15 of the tool head 4 is kept in its closed position. When the pin 62 arranged in the pivotable head part 15 moves along the curved slot 64 at an angle to and away from the above mentioned slots 22, 24, the pivotable head part 15 of the tool head 4 leaves its closed position and opens up. When the pin 62 reaches its most distal position along the curved slot 64, the pivotable head part 15 of the tool head 4 has reached its open position.

Figure 6:
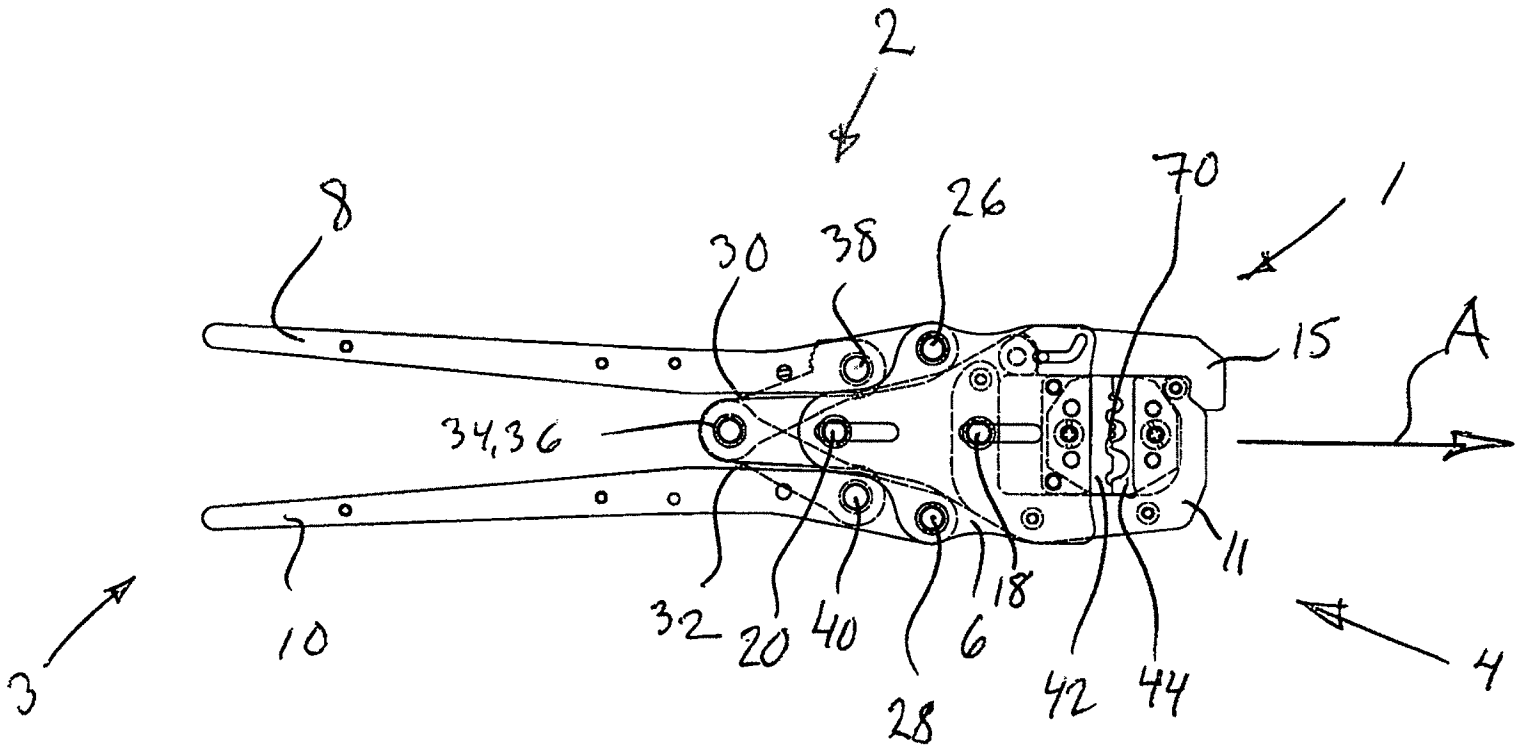
FIG. 6 shows schematically a view of a hand operated crimping tool having a tool head comprising a pivotable head part according to the fifth embodiment of the invention, shown in a crimping position.

FIG. 6 shows schematically a view of a hand operated crimping tool 2 having a tool head comprising a pivotable head part 15 according to the fifth embodiment of the invention, shown in a crimping position.

As can be seen from FIG. 6 when comparing FIG. 5 with FIG. 6, the pivotable head part 15 of the tool head 4 arranged distally 1 on the hand operated crimping tool 2 is automatically moved between an open head position (as shown in FIG. 5) and a closed head position (as shown in FIG. 6) depending on the relative position of the tool handles 8, 10 arranged proximally 3 on the crimping tool 2, as the movement of the handles 8, 10 is connected to the movement of the tool head 4, more specifically to the movement of the main head part 11 and the pivotable head part 15 of the tool head 4. This is accomplished by arranging the main head part 11 axially slidable along the body 6, by arranging the pivotable head part 15 pivotally to the main head part 11 and pivotally slidable along the body 6, by arranging the handles 8, 10 pivotally to the body 6, and by connecting the respective handles 8, 10 to the main head part 11 via respective toggles 30, 32 pivotally arranged to the main head part 11 and to the respective handles 8, 10, as has been discussed in connection with FIG. 5.

When the handles 8, 10 are pressed together, the handles 8, 10 pivot around their respective pivot point 26, 28 arranged on the body 6, whereby the toggles 30, 32 pivot around their respective distal pivot point 38, 40 arranged on the respective handle 8, 10, thereby moving their respective proximal pivot point 34, 36 where they are pivotally attached to the main head part 11 of the tool head 4 proximally along the crimping tool 2, thus moving the distal end of the tool head 4 proximally along the crimping tool 2 towards the body 6. This results in that the distal crimping die 44 arranged at the tool head 4, in this embodiment at the main head part 11, is moved by a toggle mechanism towards the proximal crimping die 42 arranged at the body 6, the crimping dies 42, 44 thus being arranged to be brought towards each other in order to crimp at least one workpiece (not shown in this embodiment) arranged in a crimping aperture 70 arranged between the crimping dies 42, 44. When parting the tool handles 8, 10, the tool head 4 moves in the opposite direction, i.e. from the position shown in FIG. 3 towards the position shown in FIG. 5.

When at least two pins 18, 20 are used in order to control the movement of the main head part 11 relative to the body 6, the above discussed arrangement of the toggles 30, 32 enables arranging the pins 18, 20 far apart this increasing the alignment of the main head part 11 with the tool 2 axis A and decreasing the possible tilt between the tool 2 axis A and the main head part 11.

Figure 7:
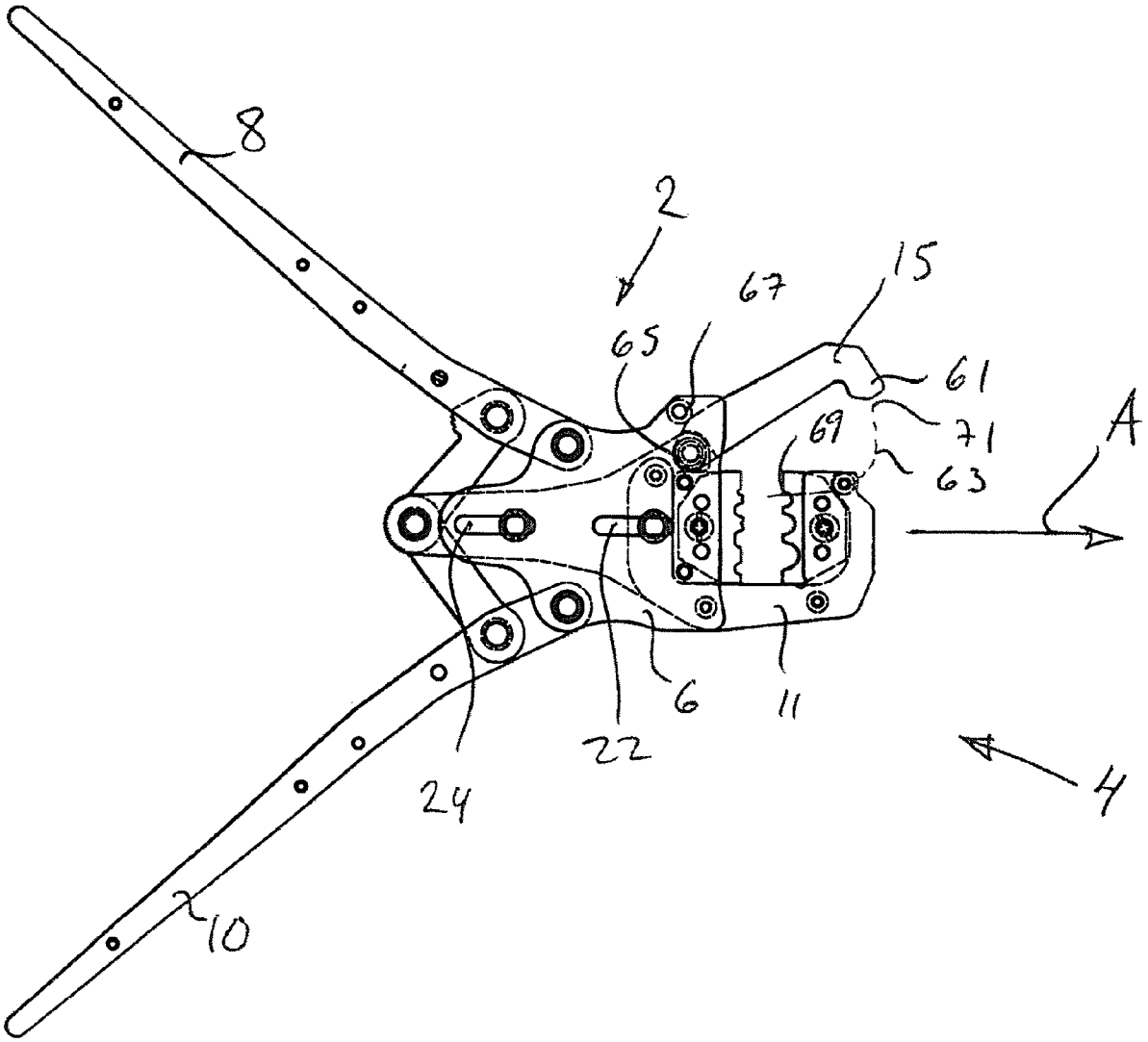
FIG. 7 shows schematically a view of a hand operated crimping tool having a tool head comprising a pivotable head part according to a sixth embodiment of the invention, shown in a non-crimping position.

FIG. 7 shows schematically a view of a hand operated crimping tool having a tool head comprising a pivotable head part 15 according to a sixth embodiment of the invention, shown in a non-crimping position.

The embodiment shown in FIG. 7 differs from the embodiment shown in FIG. 5 in that in order to achieve that the pivotable head part 15 of the tool head 4 is automatically moved between an open head position and a closed head position depending on the relative position of the tool handles 8, 10, the free end 61 of the pivotable head part 15 is further arranged to be slidably guided along a curved path 63 in relation to the body 6 by arranging a pre-tensioned spring 65 arranged to push the free end 61 of the pivotable head part 15 away from the main head part 11, and arranging a support means 67 in the body 6 along which the pivotable head part 15 is arranged to slide, the design of the contact surfaces between the support means 67 and the pivotable head part 15 defining the curved path 63. The support means 67 may e.g be a pin or a wheel.

The curved path 63 is arranged at its proximal end 69 to extend in parallel with the above mentioned slots 22, 24 extending axially A along the tool 2, whereas the curved path 63 is arranged towards its distal end 71 to extend at an angle to and away from the above mentioned slots 22, 24. Thus, when the free end 61 of the pivotable head part 15 moves along the curved path 63 in parallel to the above mentioned slots 22, 24, the pivotable head part 15 of the tool head 4 is kept in its closed position. When the free end 61 of the pivotable head part 15 moves along the curved path 63 at an angle to and away from the above mentioned slots 22, 24, the pivotable head part 15 of the tool head 4 leaves its closed position and opens up. When free end 61 of the pivotable head part 15 reaches its most distal position along the curved path 63, the pivotable head part 15 of the tool head 4 has reached its open position.

Figure 8:
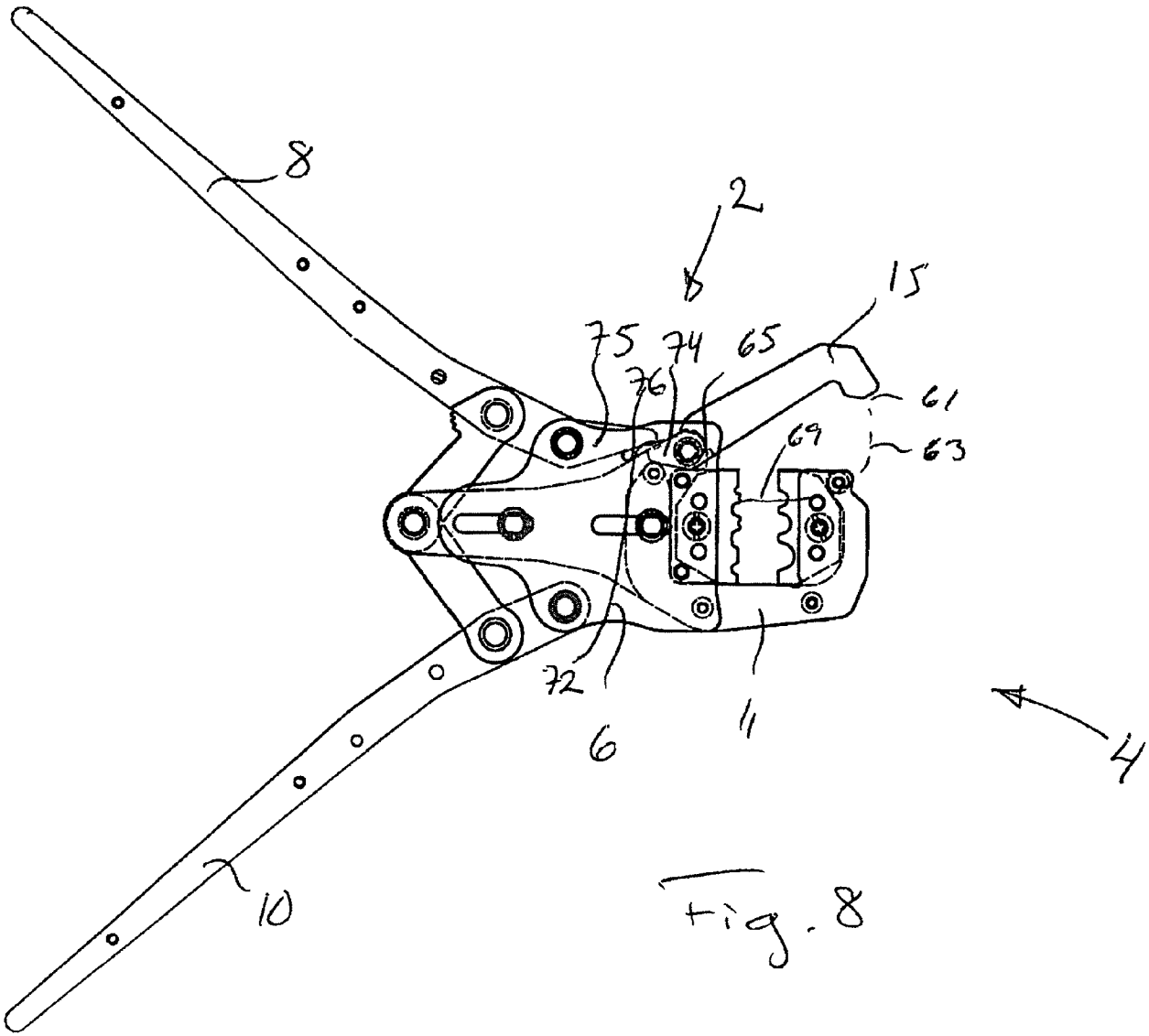
FIG. 8 shows schematically a view of a hand operated crimping tool having a tool head comprising a pivotable head part according to a seventh embodiment of the invention, shown in a non-crimping position.

FIG. 8 shows schematically a view of a hand operated crimping tool 2 having a tool head 4 comprising a pivotable head part 15 according to a seventh embodiment of the invention, shown in a non-crimping position.

The embodiment shown in FIG. 8 differs from the embodiment shown in FIG. 5 in that in order to achieve that the pivotable head part 15 of the tool head 4 is automatically moved between an open head position and a closed head position depending on the relative position of the tool handles 8, 10, a cam surface 72 at the to the body 6 attached end 74 of the pivotable head part 15 is arranged to be slidably guided along a cam surface 76 at to the body 6 attached end 75 of a pivotably to the body 6 arranged handle 8. Said cam surface 72 of the pivotable head part 15 is arranged to pivot in the opposite direction of the distal free end 61 of the pivotable head part 15, and said cam surface 76 on the handle 8 is arranged to pivot in the opposite direction of the proximal free end of the handle 8. A pre-tensioned spring 65 is arranged to push the free end 61 of the pivotable head part 15 against the main head part 11, thereby pushing the cam surface 72 of the pivotable head part 15 towards the cam surface 76 on the handle 8. Thus, when the handles 8, 10 are moved apart, the cam surface 76 on the handle pushes against the pivotable head part 15 thereby opening the tool head against the force of the spring 65, and when the handles 8, 10 are moved towards each other, the pivotable head part 15 is no longer blocked by the cam surface 76 on the handle 8 and may move towards the main head part 11 thus closing the tool head.

The free end 61 of the pivotable head part 15 is thus arranged to be slidably guided along a curved path 63 in relation to the body 6, where the design of the cam surfaces define the curved path 63.

Figure 9:
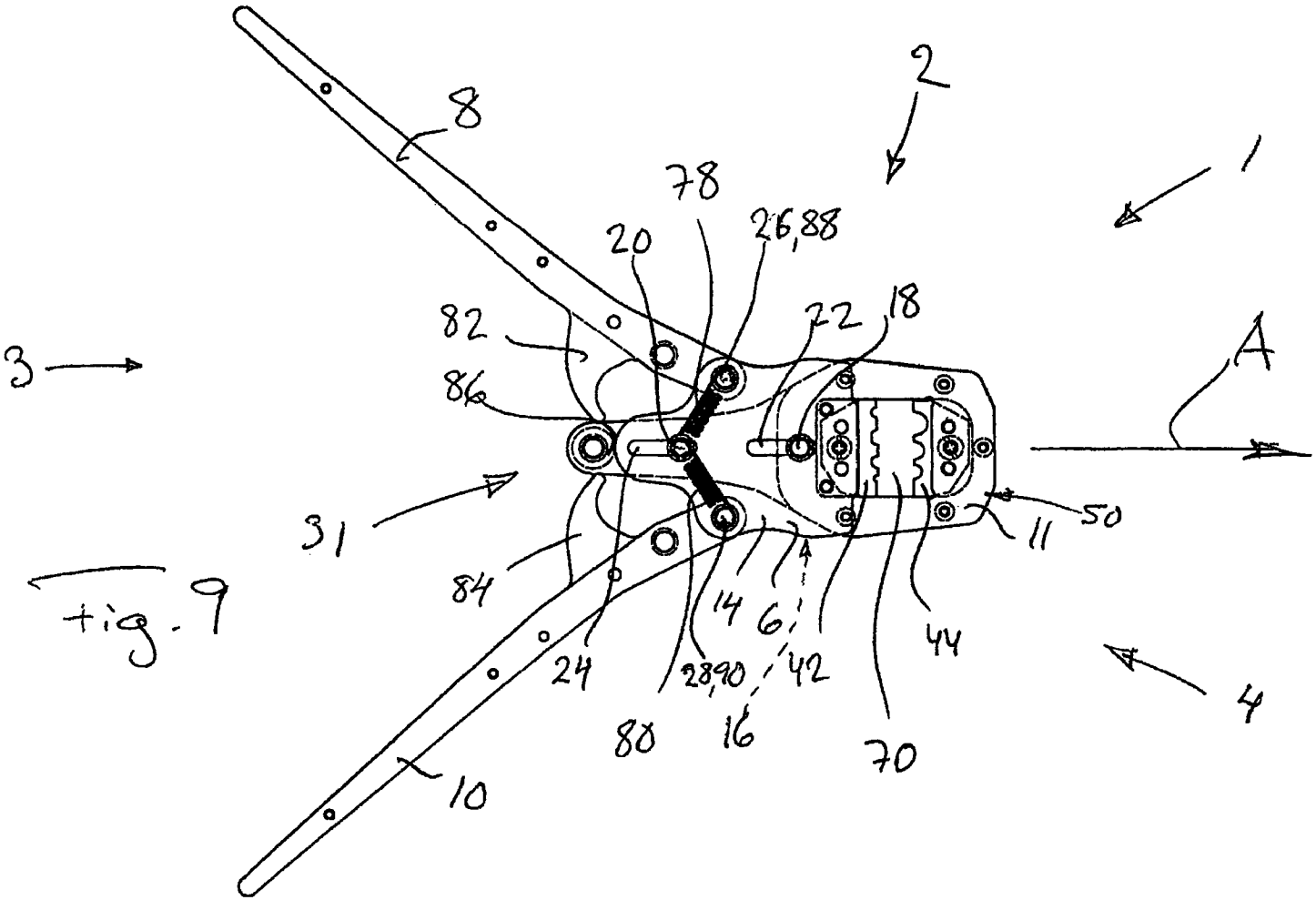
FIG. 9 shows schematically a side view of a hand operated crimping tool having a closed tool head according to an eight embodiment of the invention, shown in a non-crimping position.

FIG. 9 shows schematically a side view of a hand operated crimping tool 2 having a closed tool head 4 according to an eight embodiment of the invention, shown in a non-crimping position.

As can be seen in FIG. 9 (and which also applies to all the other embodiments described herein), at least one return spring 78, 80, in this embodiment two return springs 78, 80, is arranged to move the tool handles 8, 10 apart when the force pressing the tool handles 8, 10 towards each other is released, thus moving the distal end 50 of the tool head 4 away from the body 6.

The embodiment shown in FIG. 9 differs from the embodiment shown in FIG. 1 in that the tool head 4 is closed, and in that the movement of the pivotally to the body 6 arranged handles 8, 10 is arranged connected to the movement of the main head part 11 by a mechanism 31, which here is a cam mechanism, whereby the tool head 4 is arranged movable between a distal non-crimping position and a proximal crimping position depending on the relative position of the tool handles 8, 10 and thus automatically movable between an open head position and a closed head position depending on the relative position of the tool handles 8, 10.

The body 6 is arranged between the distal end 1 and the proximal end 3 of the crimping tool 2. The tool head 4 is arranged distally 1 on the crimping tool 2, and the two handles 8, 10 are arranged proximally 3 on the crimping tool 2. The tool head 4 comprises a main head part 11 arranged to extend along the body 6. The body 6 preferably comprises two body parts 14, 16 between which the main head part 11 is arranged to slide. For clarity, the parts of the main head part 11 which are obscured by the body part 14 are shown with dashed lines in the figure. The main head part is slidably attached to the body 6 using pins 18, 20 arranged to slide in respective slots 22, 24 extending axially A along the tool 2, where preferably at least two pins 18, 20 are used in order to control the movement of the main head part 11 relative to the body 6. The slots 22, 24 may be arranged in the body 6 or in the main head part 11, and the pins may be arranged in the main head part 11 or in the body 6, respectively. The handles 8, 10 are pivotably attached to the body 6 at pivot points 26, 28.

The main head part 11 is arranged axially A slidable along the body 6. Crimping dies 42, 44 are further preferably removably arranged at the body 6 and the main head part 11, respectively, between which crimping dies 42, 44 at least one workpiece (not shown in this figure) is arranged to be crimped when the crimping dies 42, 44 are moved towards each other. For clarity, the parts of the crimping dies 42, 44 which are obscured e.g. by one body part 14 or the main head part 11 are shown with dashed lines in the figure.

The handles 8, 10 are further connected to the main head part 11 by a mechanism 31 which is a cam mechanism comprising at least one cam 82, 84, in this embodiment two cams 82, 84, which cams 82, 84 are attached to a respective handle 8, 10, and which cams are arranged to engage an at the main head part 11 arranged cam following means 86 such as e.g. a pin arranged on the main head part 11.

When the handles 8, 10 are pressed together, the handles 8, 10 pivot around their respective pivot point 26, 28 arranged on the body 6, whereby the respective cams 82, 84 are moved towards the cam following means 86. When the respective cams 82, 84 engage the cam following means 86, the cam following means 86 arranged on the main head part 11 is moved together with the main head part 11 proximally along the crimping tool 2, thus moving the distal end 50 of the tool head 4 proximally along the crimping tool 2 towards the body 6. This results in that the distal crimping die 44 arranged at the tool head 4, in this embodiment at the main head part 11, is moved by a cam mechanism towards the proximal crimping die 42 arranged at the body 6, the crimping dies 42, 44 thus being arranged to be brought towards each other in order to crimp at least one workpiece (not shown in this embodiment) arranged in a crimping aperture 70 arranged between the crimping dies 42, 44. When the main head part 11 moves proximally along the body 6, the return springs 78, 80 arranged between the main head part 11 and the body 6, e.g. arranged between a pin 20 arranged on the main head part 11 and a respective pin 88, 90 arranged on the body 6, are tensioned thereby increasing a return spring force trying to move the tool handles 8, 10 apart. Thus, when the force pressing the tool handles 8, 10 towards each other is released, the return spring force from the tensioned return springs 78, 80 is arranged to move the tool handles 8, 10 apart thus moving the distal end 50 of the tool head 4 in the opposite direction away from the body 6.

As mentioned above, the main head part 11 is slidably attached to the body 6 using at least one pin arranged to slide in at least one slot, and the possible pivotable head part 15 is further arranged to be slidably guided along a curved path along the body 6 by using at least one pin arranged to slide in a curved slot. As mentioned above, the body 6 preferably comprises two body parts 14, 16 between which the main head part 11 is arranged to slide.

The main head part 11 is preferably slidably attached to both body parts 14, 16 of the body 6, e.g. by using at least one pin attached to both body parts 14, 16 and arranged to slide in at least one slot in the main head part 11, or using at least one pin attached to the main head part 11 and arranged to slide in at least one slot arranged in each of the body parts 14, 16.

The pivotable head part 15 is further preferably arranged to be slidably guided along a curved path along both body parts 14, 16 of the body 6, e.g. by using at least one pin attached to both body parts 14, 16 and arranged to slide in a curved slot in the pivotable head part 15, or by using at least one pin attached to the pivotable head part 15 and arranged to be slidably guided along a curved slot arranged in each of the body parts 14, 16. Another possible embodiment is to arrange the free end 61 of the pivotable head part 15 to be slidably guided along a curved path 63 in relation to the body 6 by arranging a pre-tensioned spring 65 arranged to push the free end 61 of the pivotable head part 15 away from the main head part 11, and arranging a support means 67 in the body 6 along which the pivotable head part 15 is arranged to slide, as mentioned above. A further possible embodiment is to arrange the free end 61 of the pivotable head part 15 to be slidably guided along a curved path 63 in relation to the body 6 by arranging a pre-tensioned spring 65 arranged to push the free end 61 of the pivotable head part 15 against the main head part 11, and arranging a cam surface 72 at the to the body 6 attached end 74 of the pivotable head part 15 is to be slidably guided along a cam surface 76 at to the body 6 attached end of a pivotably to the body 6 arranged handle 8, as mentioned above.

The mechanism 31 connecting the handles and the tool head is preferably a toggle mechanism or a cam mechanism as discussed in the embodiments above, but may also be another mechanism which in a similar way connects the movement of the at least one pivotable handle and the movement of the tool head, such as e.g. a toothed wheel mechanism.

The features of the embodiments discussed above may be combined in further ways than those explicitly described in the embodiments above. The invention thus relates to a hand operated crimping tool 2 comprising a body 6 arranged between a distal end 1 and a proximal end 3 of the crimping tool 2, a tool head 4 arranged distally 1 on the crimping tool 2, and handles 8, 10 arranged proximally 3 on the crimping tool 2, where at least one handle 8, 10 is arranged pivotally to the body 6, where the tool head 4 is arranged axially A slidable along the body 6, where a distal crimping die 44 is arranged at the tool head 4 and a proximal crimping die 42 is arranged at the body between which crimping dies 42, 44 a workpiece 43 is to be crimped, and in that the movement of the at least one pivotally to the body 6 arranged handle 8, 10 is arranged connected to the movement of the tool head 4 by a mechanism 31, whereby the tool head 4 is arranged movable between a distal non-crimping position and a proximal crimping position depending on the relative position of the tool handles 8, 10.

Crimping tools utilizing the invention may as described above be arranged with an open head or a closed head. In a tool having an open head, the head has to be much stronger than in a tool having a closed head in order to withstand the same amount of maximum crimping force, this due to that an open head design is less rigid than a closed head design and will flex more easily during crimping.

A crimping tool with a closed head will thus be lighter than a crimping tool with an open head designed for the same amount of maximum crimping force if the crimping tools are made of the same material, this resulting in less load on the user.

A crimping tool with an open head shows on the other hand the advantage that it is possible to e.g. crimp together the ends of two very long wires and thereafter to remove the crimping tool from the crimped wires without having to pull the crimped wires through the head of a crimping tool having a closed head. Further, if the "non-crimped" ends of the two crimped wires are not free which e.g. is the case when these ends already are fixed to e.g. a respective electrical distribution box, it is impossible to remove the crimped wires after crimping from a tool having a closed head.

Crimping tools utilizing the invention may as described above also be arranged with an pivotable head part thereby making use of the above mentioned advantages of both hand crimping tools having open heads and hand crimping tools having closed heads.

In the above described embodiments, the tool head is arranged slidably attached to the body using at least one pin arranged to slide in at least one slot extending axially along the tool. It is also possible to arrange the tool head slidably attached to the body using other guiding means such as e.g. guiding elements arranged in the body between which the tool head is guided when sliding along the body.

What is claimed is:

1. Hand operated crimping tool comprising a body arranged between a distal end and a proximal end of the crimping tool, a tool head arranged distally on the crimping tool, and handles arranged proximally on the crimping tool, where at least one handle is arranged pivotally to the body, and wherein the tool head is arranged axially slidable along the body, and a distal crimping die is arranged at the tool head and a proximal crimping die is arranged at the body between which crimping dies a workpiece is to be crimped, and wherein the movement of the at least one handle that is arranged pivotally to the body is connected to the movement of the tool head by a mechanism, whereby the tool head is arranged movable between a distal non-crimping position and a proximal crimping position depending on the relative position of the tool handles; and wherein the tool head comprises a main head part and a pivotably thereto attached pivotable head part; and wherein the pivotable head part is further arranged to be slidably guided along a curved path along the body by using at least one pin arranged to slide in a curved slot defining the curved path, where the curved slot is arranged in the body, and at least one pin is arranged in the pivotable head part.

2. Hand operated crimping tool according to claim 1, wherein the curved slot is arranged at its proximal end to extend in parallel with slots extending axially along the tool, whereas the curved slot is arranged towards its distal end to extend at an angle to and away from the above mentioned slots.

3. Hand operated crimping tool according to claim 1, wherein two handles are arranged pivotally to the body.

4. Hand operated crimping tool according to claim 1, wherein the mechanism arranged to connect the movement of the at least one pivotally to the body arranged handle to the movement of the tool head is a toggle mechanism.

5. Hand operated crimping tool according to claim 4, wherein two pivotally to the body arranged handles are connected to a main head part of the tool head by respective toggles pivotably attached to the main head part and the respective handle.

6. Hand operated crimping tool according to claim 1, wherein the mechanism arranged to connect the movement of the at least one pivotally to the body arranged handle to the movement of the tool head is a cam mechanism.

7. Hand operated crimping tool according to claim 6, wherein cams attached to two pivotally to the body arranged handles are arranged to engage an at a main head part of the tool head arranged cam following means, and at least one return spring is arranged between the main head part and the body.

8. Hand operated crimping tool according to claim 1, wherein the tool head is arranged slidably attached to the body using at least one pin arranged to slide in at least one slot extending axially along the tool.

9. Hand operated crimping tool according to claim 8, wherein the tool head comprises a main head part arranged slidably attached to the body using at least two pins arranged to slide in at least one slot extending axially along the tool.

10. Hand operated crimping tool according to claim 8, wherein the at least one slot is arranged in a main head part, and the at least one pin is arranged in the body.

11. Hand operated crimping tool according to claim 8, wherein the at least one slot is arranged in the body, and the at least one pin is arranged in a main head part.

12. Hand operated crimping tool according to claim 1, wherein the body comprises two body parts between which the tool head is arranged to slide.

13. Hand operated crimping tool according to claim 12, wherein the tool head comprises a main head part slidably attached to the two body parts.

14. Hand operated crimping tool according to claim 1, wherein the tool head is closed.

15. Hand operated crimping tool according to claim 1, wherein the pivotable head part is arranged pivotally slidable along a curved path along the body.

16. Hand operated crimping tool according to claim 1, wherein exchangeable crimping dies are removably fastened at the body and a main head part of the tool head, respectively.

17. Hand operated crimping tool according to claim 1, wherein the tool head comprises a main head part comprising at least one distal part and at least one proximal part, each part having an distal end and an proximal end, where a crimping die is arranged at the distal end of the distal part, and where the distal end of the proximal part is attached to the proximal end of the distal part and where the pivotable head part is pivotably attached to the distal end of the proximal part.

18. Hand operated crimping tool comprising a body arranged between a distal end and a proximal end of the crimping tool, a tool head arranged distally on the crimping tool, and handles arranged proximally on the crimping tool, where at least one handle is arranged pivotally to the body, and wherein the tool head is arranged axially slidable along the body, and a distal crimping die is arranged at the tool head and a proximal crimping die is arranged at the body between which crimping dies a workpiece is to be crimped, and wherein the movement of the at least one handle that is arranged pivotally to the body is connected to the movement of the tool head by a mechanism, whereby the tool head is arranged movable between a distal non-crimping position and a proximal crimping position depending on the relative position of the tool handles; and wherein the tool head comprises a main head part and a pivotably thereto attached pivotable head part; and wherein the pivotable head part is further arranged to be slidably guided along a curved path along the body by using at least one pin arranged to slide in a curved slot defining the curved path, where the curved slot is arranged in the pivotable head part such that the pivotable head part defines one side of the curved slot such that the side is not open-ended, and at least one pin is arranged in the body.

19. Hand operated crimping tool according to claim 18, wherein the curved slot is arranged at its proximal end to extend in parallel with slots extending axially along the tool such that when the at least one pin slides along the curved path the pivotable head part of the tool is in a closed position, and arranged towards its distal end to extend at an angle to and away from the said slots such that when the at least one pin slides along the curved path the pivotable head part of the tool is in an open position.

20. Hand operated crimping tool comprising a body arranged between a distal end and a proximal end of the crimping tool, a tool head arranged distally on the crimping tool, and handles arranged proximally on the crimping tool, where at least one handle is arranged pivotally to the body, and wherein the tool head is arranged axially slidable along the body, and a distal crimping die is arranged at the tool head and a proximal crimping die is arranged at the body between which crimping dies a workpiece is to be crimped, and wherein the movement of the at least one handle that is arranged pivotally to the body is connected to the movement of the tool head by a mechanism, whereby the tool head is arranged movable between a distal non-crimping position and a proximal crimping position depending on the relative position of the tool handles; and wherein the tool head comprises a main head part and a pivotably thereto attached pivotable head part; and wherein the body comprises two body parts between which the tool head is arranged to slide and where the pivotable head part is arranged to be slidably guided along a curved path along both body parts by using at least one pin attached to both body parts and arranged to slide in a curved slot in the pivotable head part, wherein the pivotable head part defines one side of the curved slot such that the side is not open-ended, or by using at least one pin attached to the pivotable head part and arranged to be slidably guided along a curved slot arranged in each of the body parts.

* * * * *